US009463568B2

(12) United States Patent
Chen et al.

(10) Patent No.: US 9,463,568 B2
(45) Date of Patent: Oct. 11, 2016

(54) HEX KEY WRENCH SYSTEM

(71) Applicants: Tsan-Lung Chen, Taichung (TW); Ka-Chung Ho, Taichung (TW)

(72) Inventors: Tsan-Lung Chen, Taichung (TW); Ka-Chung Ho, Taichung (TW)

(73) Assignees: TOP GOAL Enterprise Limited; Ka-Chung Ho

( * ) Notice: Subject to any disclaimer, the term of this patent is extended or adjusted under 35 U.S.C. 154(b) by 7 days.

(21) Appl. No.: 14/611,277

(22) Filed: Feb. 1, 2015

(65) Prior Publication Data

US 2016/0207189 A1 Jul. 21, 2016

(51) Int. Cl.

| | |
|---|---|
| ***B25B 23/16*** | (2006.01) |
| ***B25G 1/06*** | (2006.01) |
| ***B25B 15/00*** | (2006.01) |
| ***B25G 1/04*** | (2006.01) |

(52) U.S. Cl.

CPC ..... *B25G 1/063* (2013.01); *B25B 15/008* (2013.01); *B25G 1/043* (2013.01)

(58) Field of Classification Search

CPC ..... B25G 1/063; B25G 1/043; B25G 15/008

USPC ..... 81/177.2–177.85

See application file for complete search history.

(56) References Cited

U.S. PATENT DOCUMENTS

| | | | | |
|---|---|---|---|---|
| 4,043,230 | A * | 8/1977 | Scrivens | B25B 13/56 81/177.2 |
| D415,946 | S * | 11/1999 | Tsai | D8/105 |
| 6,332,381 | B1 * | 12/2001 | Vasudeva | B25B 15/008 81/177.1 |
| 6,367,628 | B2 * | 4/2002 | Hu | B25H 3/003 206/372 |
| 6,510,766 | B1 * | 1/2003 | Lin | B25B 15/008 81/177.4 |
| 7,281,455 | B2 * | 10/2007 | Hu | B25G 1/085 81/177.4 |
| 7,946,203 | B2 * | 5/2011 | Johnson | B25B 15/008 81/177.4 |
| 8,037,577 | B2 * | 10/2011 | Chen | B25G 1/085 16/111.1 |
| 8,443,973 | B1 * | 5/2013 | Hsu | B25H 3/003 206/372 |
| 8,534,166 | B2 * | 9/2013 | Hsu | B25G 1/085 81/177.4 |

* cited by examiner

*Primary Examiner* — Hadi Shakeri
*Assistant Examiner* — Danny Hong

(57) ABSTRACT

A wrench system includes an outer case and an inner case which is slidably inserted in the outer case. The outer case has a first slot defined axially therein. The first slot has a first opening and a first closed end. The inner case has a second slot defined axially therein. The second slot has a second opening and a second closed end. The inner case has multiple first holes defined through the bottom thereof and the second slot so as to receive a non-circular insertion portion of a tool. The first holes has different sizes so that the handle is cooperated with different sizes of the L-shaped wrenches.

9 Claims, 7 Drawing Sheets

HEX KEY WRENCH SYSTEM

BACKGROUND OF THE INVENTION

1. Fields of the Invention

The present invention relates to a wrench system, and more particularly, to a handle for being cooperated with different sizes of L-shaped wrenches.

2. Descriptions of Related Art

The conventional L-shaped wrench comprises a long column and a short column, and each of the two columns has a hexagonal cross section so as to be engaged with the bolt with a sink hole. However, the long column and the short column of the L-shaped wrench is not long enough when holding one of which to apply torque to the object. A handle is developed to be cooperated with the L-shaped wrench, the long column or the short column of the L-shaped wrench is inserted into the reception hole of the handle, and the user holds the handle to rotate the L-shaped wrench. Nevertheless, the conventional handle usually can only be cooperated with one size of the L-shaped wrench so that there is a need to improve the shortcomings of the conventional handle for L-shaped wrenches.

The present invention intends to provide a handle for L-shaped wrenches to eliminate the shortcomings mentioned above.

SUMMARY OF THE INVENTION

The present invention relates to a wrench system for L-shaped hex wrench comprising an outer case having a first end and a second end. A first intermediate section is formed between the first and second ends. The first intermediate section has a grip which is formed by a first top of the first intermediate section and two sidewalls extending downward from two sides of the first top. The first intermediate section has a first bottom which has a first slot defined axially therein. The first slot has a first opening and a first closed end. The first opening is located at the first end of the outer case. The first closed end is located at the second end of the outer case.

An inner case has a third end and a fourth end. A second intermediate section is formed between the third and fourth ends. The first intermediate section is slidably mounted to the second intermediate section. The second intermediate section has a body which is formed by a second bottom of the second intermediate section and two sidewalls extending upward from two sides of the second bottom. The second intermediate section has a second top which has a second slot defined axially therein. The second slot has a second opening and a second closed end. The second opening is located at the third end of the inner case. The second closed end is located at the fourth end of the inner case. The body has multiple first holes defined through the second bottom and the second slot. The first holes receive a non-circular insertion portion of a tool.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
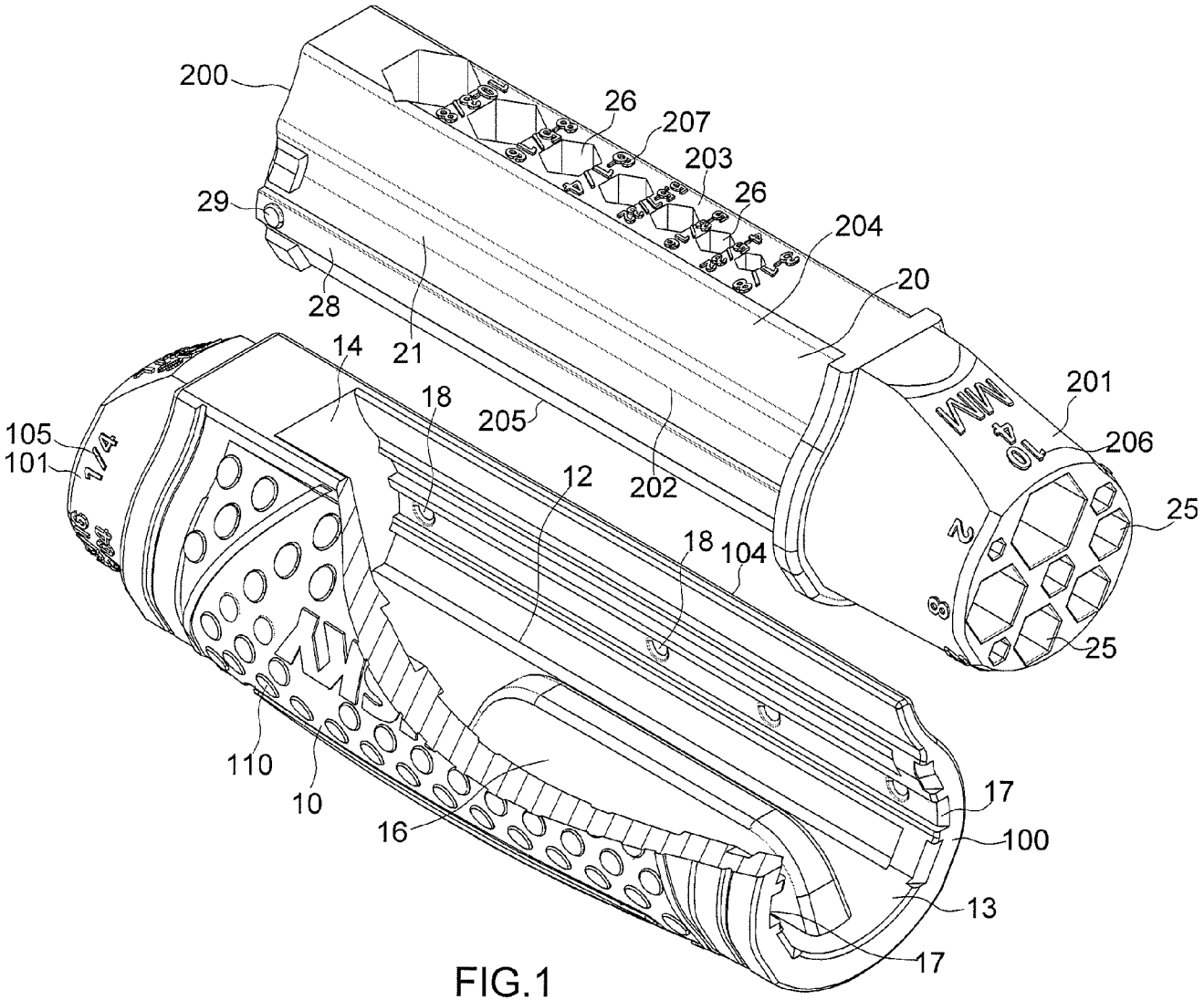
FIG. 1 is an exploded view of the handle of the present invention.
Figure 2:
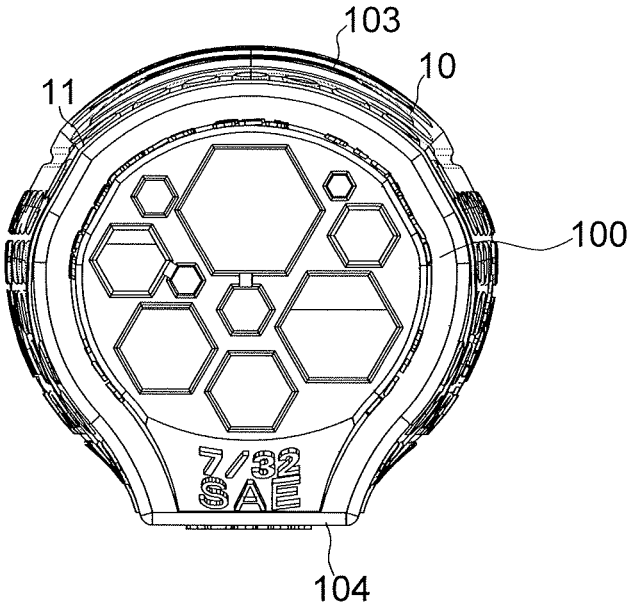
FIG. 2 is a left end view of the handle of the present invention.
Figure 3:
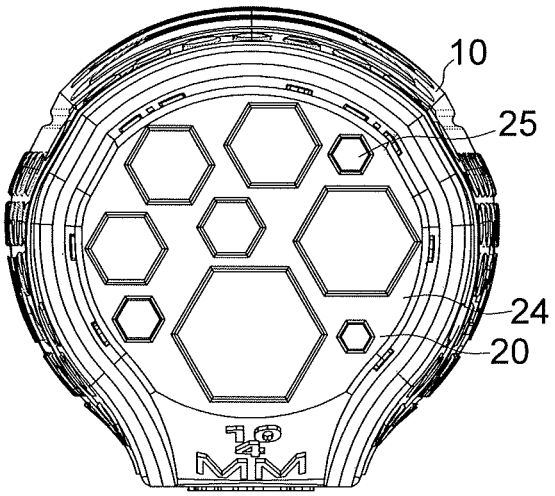
FIG. 3 is a right end view of the handle of the present invention.
Figure 4:
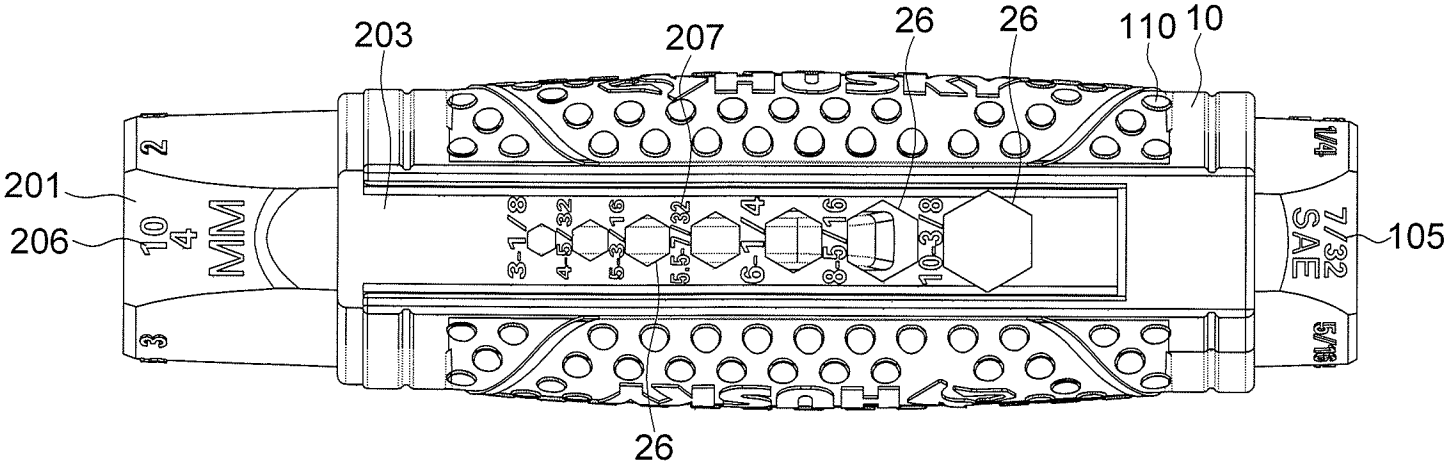
FIG. 4 is a bottom view of the handle of the present invention.
Figure 5:
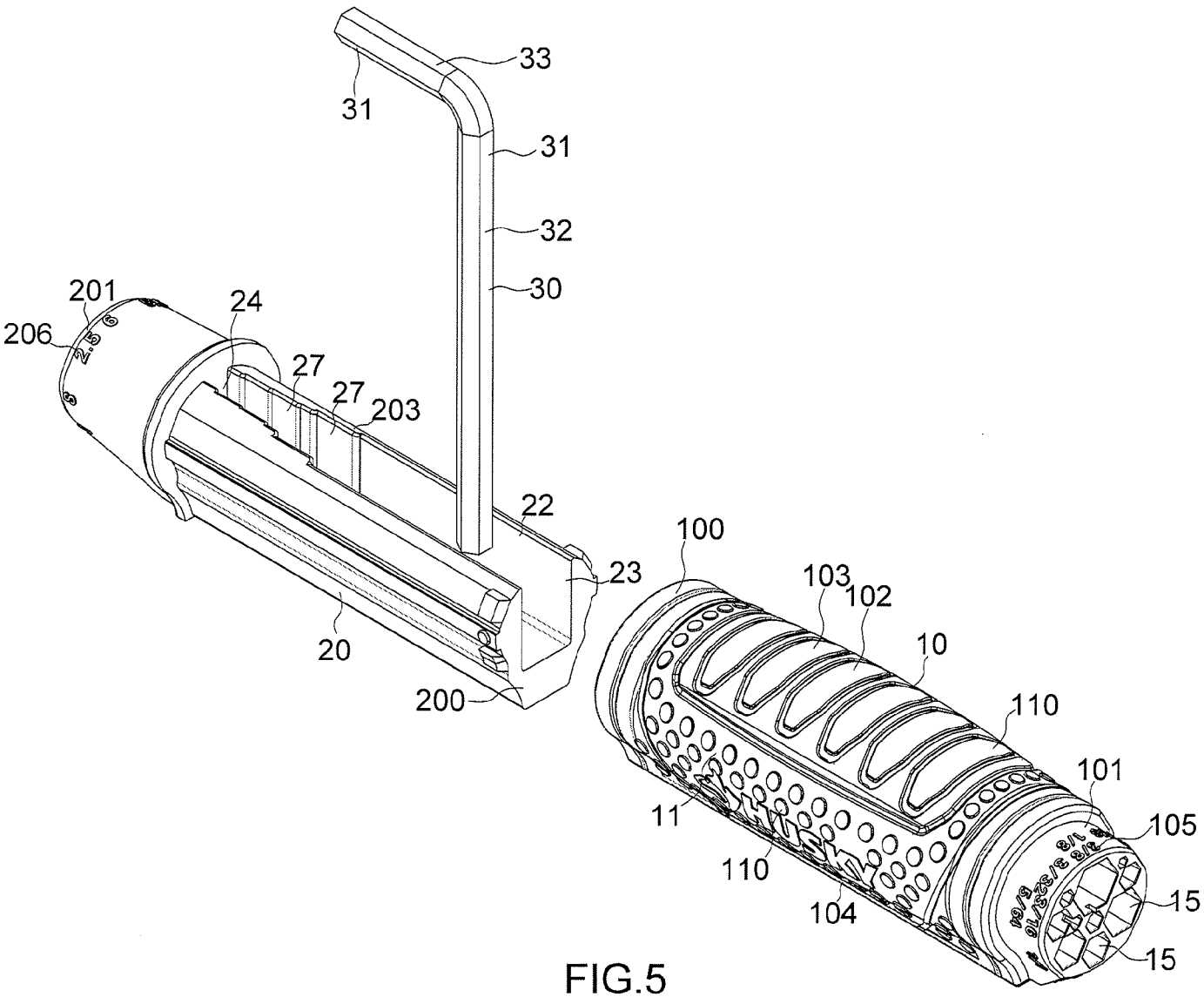
FIG. 5 shows an L-shaped wrench is to be used with the handle of the present invention.
Figure 6:
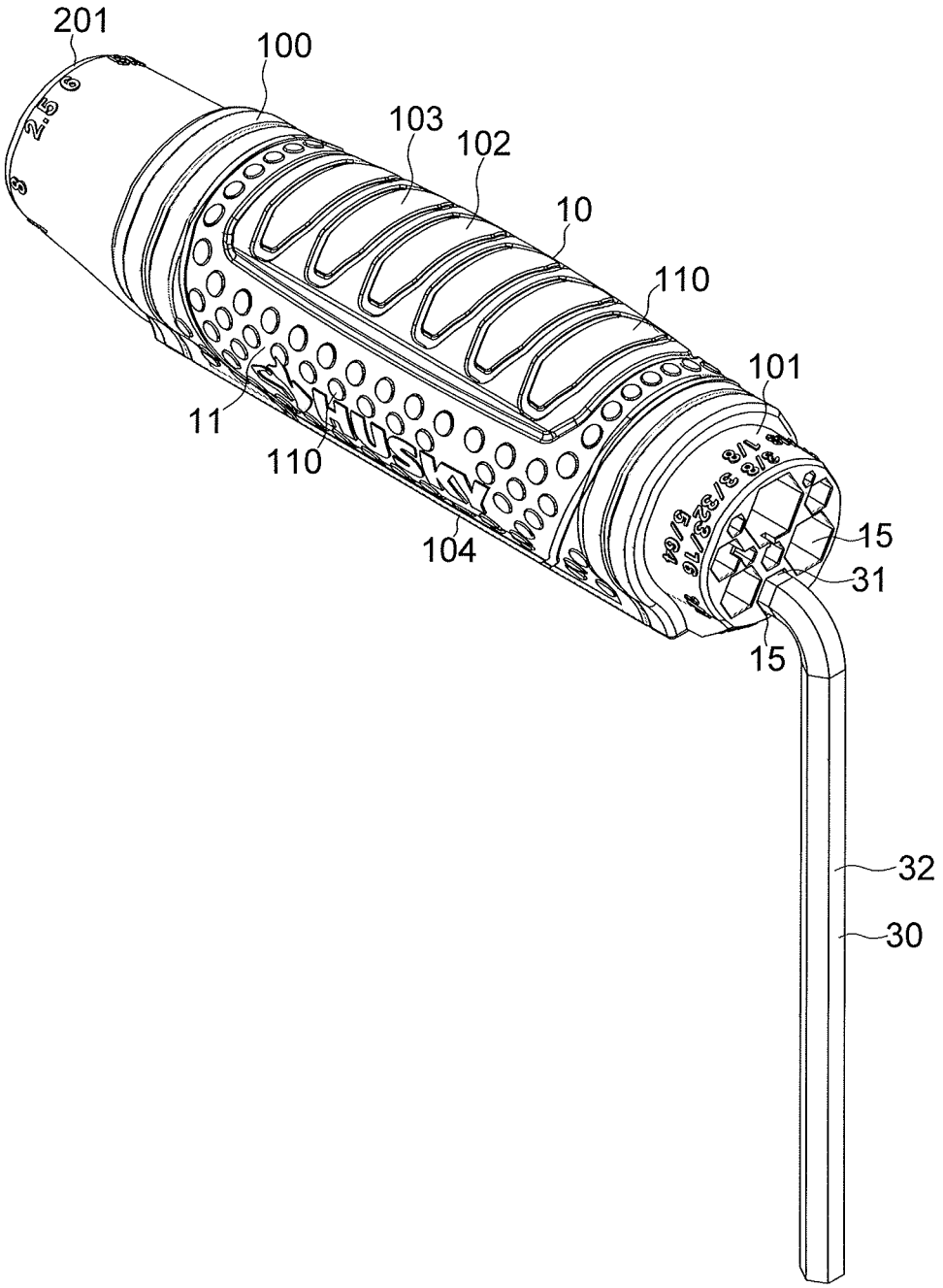
FIG. 6 shows the first type of use of the handle of the present invention and an L-shaped wrench.
Figure 7:
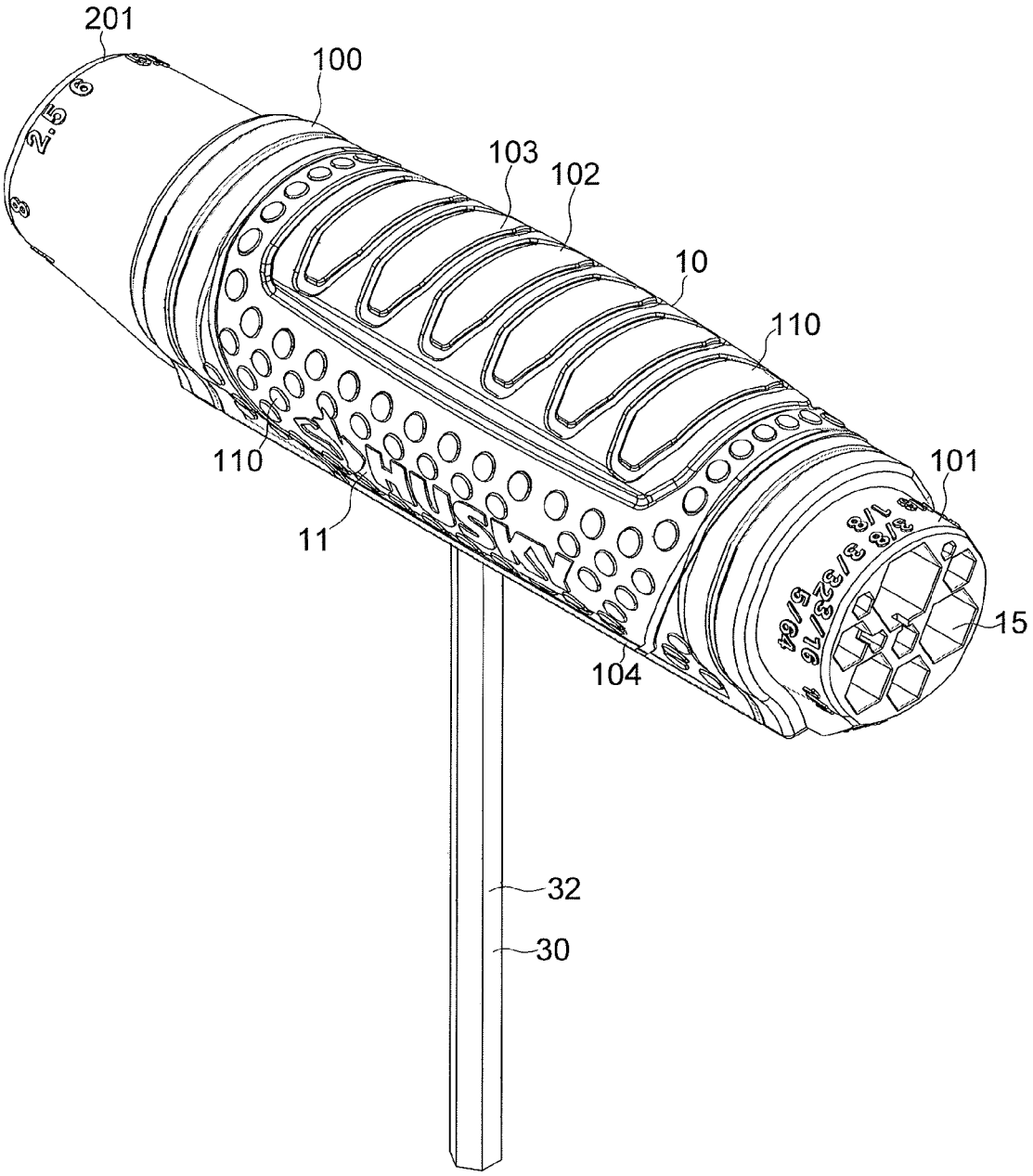
FIG. 7 shows the second type of use of the handle of the present invention and an L-shaped wrench.

Referring to FIGS. 1 to 9, the handle of the present invention comprises an outer case 10 and an inner case 20. The outer case 10 has a first end 100 and a second end 101. A first intermediate section 102 is formed between the first and second ends 100, 101. The first intermediate section 102 has a grip 11 which is formed by a first top 103 of the first intermediate section 102 and two sidewalls extending downward from two sides of the first top 103. The grip 11 has multiple bosses 110 protruding from the outer surface thereof. The first intermediate section 102 has a first bottom 104 which has a first slot 12 defined axially therein. The first slot 12 has a first opening 13 and a first closed end 14, wherein the first opening 13 is located at the first end 100 of the outer case 10, and the first closed end 14 is located at the second end 101 of the outer case 10. The first closed end 14 has multiple non-circular second holes 15 defined in the outside thereof, the second holes 15 have different sizes from each other. As shown in the drawings, the second holes 15 are hexagonal holes.

The inner case 20 has a third end 200 and a fourth end 201. A second intermediate section 202 is formed between the third and fourth ends 200, 201. The first intermediate section 102 is slidably mounted to the second intermediate section 202. The second intermediate section 202 has a body 21 which is formed by a second bottom 203 of the second intermediate section 202 and two sidewalls 204 extending upward from two sides of the second bottom 203. The second intermediate section 202 has a second top 205 which has a second slot 22 defined axially therein. The second slot 22 has a second opening 23 and a second closed end 24. The second opening 23 is located at the third end 200 of the inner case 20, and the second closed end 24 is located at the fourth end 201 of the inner case 20. The body 21 has multiple first holes 26 defined through the second bottom 203 and the second slot 22. The first holes 26 are hexagonal holes and receive a non-circular insertion portion 31 of a tool 30 which is an L-shaped wrench. The second closed end 24 has multiple non-circular third holes 25 defined in the outside thereof. The third holes 25 have different sizes from each other. The third holes 25 are hexagonal holes.

The tool 30 is an L-shaped wrench and has a first column 32 and a second column 33 which extends from the first column 32 at an angle. Each of the first and second columns 32, 33 has a hexagonal cross section. Each of the first and second columns 32, 33 is the insertion portion 31. The first holes 26, the second holes 15 and the third holes 25 have different sizes from each other so as to be cooperated with different L-shaped wrenches. The first holes 26 are sized to accept the tool 30 of Metric Units and Imperial Units, and the ratio of the sizes of the tools 30 between the Metric Units and the Imperial Units is less than 6%. The second bottom 203 has marks 207 which show the sizes of the Metric Units and the Imperial Units. The second holes 15 are sized to accept the tool 30 of Imperial Units. The second end 101 has marks 105 located on the periphery of the second end 101 and show the sizes of the Imperial Units. The third holes 25 are sized to accept the tool 30 of Metric Units. The fourth end 201 has marks 206 located on the periphery of the second end 101 and show the sizes of the Metric Units.

As shown in FIGS. 1 to 9, the tool 30 is an L-shaped tool. The second closed end 24 of the second slot 22 has multiple engaging recesses 27 defined in each of two inside thereof. The engaging recesses 27 have different sizes which reduces toward the fourth end 201. The number of the engaging recesses 27 is the same as the number of the first holes 26. The first holes 26 are hexagonal holes which have different sizes which reduces toward the fourth end 201. The engaging recesses 27 and the first holes 26 are located in pairs, each pair of the engaging recess 27 and the first hole 26 have the same width.

Figure 8:
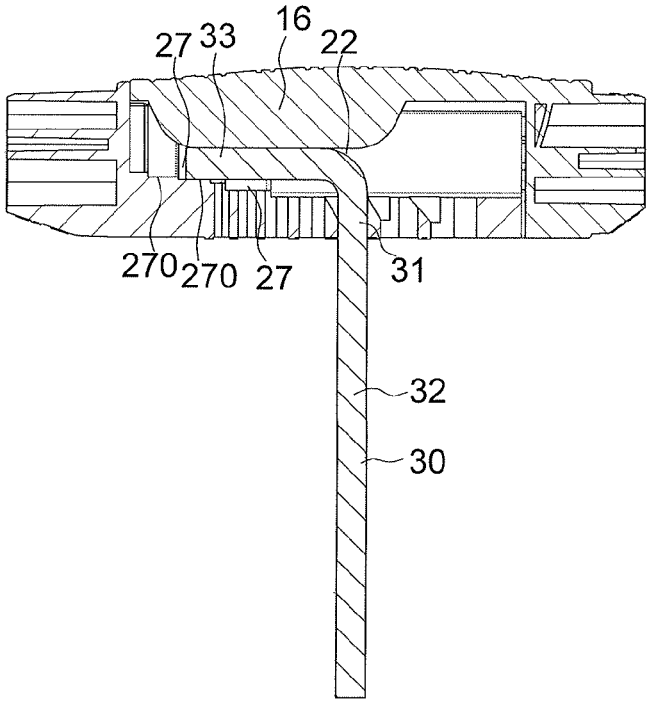
FIG. 8 is a cross sectional view to show the second type of use of the handle of the present invention and an L-shaped wrench.
Figure 9:
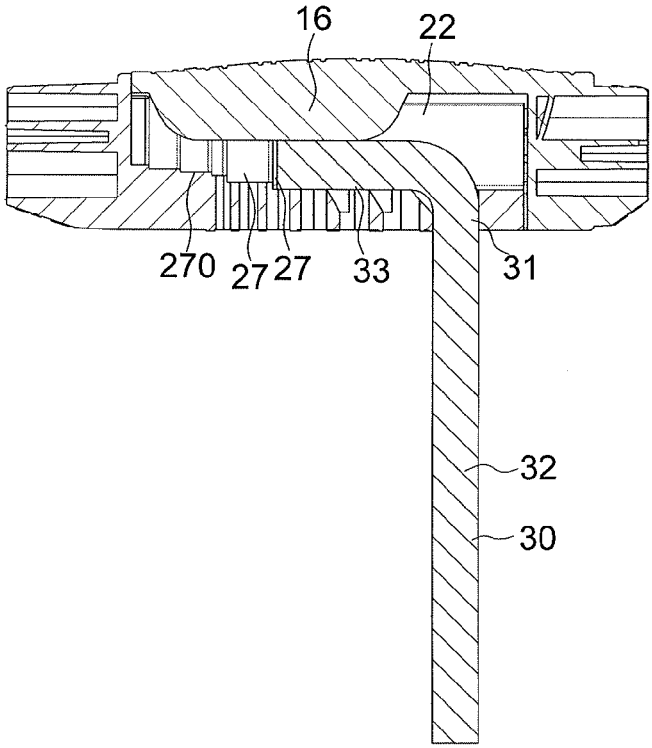
FIG. 9 is a cross sectional view to show the second type of use of the handle of the present invention and another L-shaped wrench.

A block 16 extends from the inner end of the first slot 12, and the second slot 22 has multiple contact faces 270 which are located corresponding to the engaging recesses 27. The contact faces 270 have different heights which reduces toward the fourth end 201. When the first column 32 is inserted into the first hole 26, the second column 33 is located in the second slot 22. The second column 33 is engaged with the tow facing engaging recesses 27 that matches with the size of the second column 33. The block 16 and the contact face 270 respectively contact the top and the bottom of the second column 33 as shown in FIGS. 8 and 9 to secure the L-shaped wrench.

The first slot 12 has at least two grooves 17 defined axially in an inside thereof, and the body 21 has at least two rails 28 on the outside thereof. The rails 28 are slidably engaged with the grooves 27 when the third end 200 of the inner case 20 is inserted into the first slot 12 of the outer case 10 from the first opening 13. The first holes 26 are exposed from the outer case 10.

The first slot 12 has multiple first protrusions 18 extending from an inside thereof, and the body 21 has multiple protrusions 29 on an outside thereof. When the third end 200 of the inner case 20 is inserted into the first slot 12 of the outer case 10 from the first opening 13, the second protrusions 29 are engaged with the first protrusions 18 so as to position the outer case 10 and the inner case 20.

While we have shown and described the embodiment in accordance with the present invention, it should be clear to those skilled in the art that further embodiments may be made without departing from the scope of the present invention.

What is claimed is:

1. A wrench system, comprising:

an outer case having a first end and a second end, a first intermediate section formed between the first and second ends, the first intermediate section having a grip which is formed by a first top of the first intermediate section and two sidewalls extending downward from two sides of the first top, the first intermediate section having a first bottom which has a first slot defined axially therein, the first slot having a first opening and a first closed end, the first opening located at the first end of the outer case, the first closed end located at the second end of the outer case;

an inner case having a third end and a fourth end, a second intermediate section formed between the third and fourth ends, the first intermediate section being slidably mounted to the second intermediate section, the second intermediate section having a body which is formed by a second bottom of the second intermediate section and two sidewalls extending upward from two sides of the second bottom, the second intermediate section having a second top which has a second slot defined axially therein, the second slot having a second opening and a second closed end, the second opening located at the third end of the inner case, the second closed end located at the fourth end of the inner case, the body having multiple first holes defined through the second bottom and the second slot, the first holes receiving a non-circular insertion portion of a tool;

wherein, the tool is an L-shaped tool and has a first column and a second column which extends from the first column at an angle, each of the first and second columns has a hexagonal cross section, each of the first and second columns is the insertion portion, a block extends from an inner end of the first slot, the second closed end of the second slot has multiple engaging recesses defined in each of two inside thereof, the engaging recesses have different sizes which reduces toward the fourth end, the second slot has multiple contact faces which are located corresponding to the engaging recesses, the contact faces have different heights which reduces toward the fourth end, the first column is inserted into the first hole, the second column is located in the second slot, the block and the contact face respectively contact a top and a bottom of the second column.

2. The wrench system as claimed in claim 1, wherein the first closed end has multiple non-circular second holes defined in an outside thereof, the second holes have different sizes from each other.

3. The wrench system as claimed in claim 1, wherein the second closed end has multiple non-circular third holes defined in an outside thereof, the third holes have different sizes from each other.

4. The wrench system as claimed in claim 1, wherein the first closed end has multiple hexagonal second holes defined in an outside thereof, the second holes have different sizes from each other, the second closed end has multiple hexagonal third holes defined in an outside thereof, the third holes have different sizes from each other, the first holes are hexagonal holes, the tool is an L-shaped tool and has a first column and a second column which extends from the first column at an angle, each of the first and second columns has a hexagonal cross section, each of the first and second columns is the insertion portion, the first holes, the second holes and the third holes have different sizes from each other.

5. The wrench system as claimed in claim 4, wherein the first holes are sized to accept the tool of Metric Units and Imperial Units, a ratio of the sizes of the tools between the Metric Units and the Imperial Units is less than 6%, the second holes are sized to accept the tool of Imperial Units, the third holes are sized to accept the tool of Metric Units.

6. The wrench system as claimed in claim 1, wherein a number of the engaging recesses is the same as a number of the first holes, the first holes are hexagonal holes which have different sizes which reduces toward the fourth end, the engaging recesses and the first holes are located in pairs, each pair of the engaging recess and the first hole have the same width.

7. The wrench system as claimed in claim 1, wherein The first slot has at least two grooves defined axially in an inside thereof, and the body has at least two rails on the outside thereof, the rails are slidably engaged with the grooves when the third end of the inner case is inserted into the first slot of the outer case from the first opening, the first holes are exposed from the outer case, the first holes are exposed from the outer case.

8. The wrench system as claimed in claim 1, wherein the first slot has multiple first protrusions extending from an inside thereof, the body has multiple protrusions on an outside thereof, when the third end of the inner case is inserted into the first slot of the outer case from the first opening, the second protrusions are engaged with the first protrusions so as to position the outer case and the inner case.

9. The wrench system as claimed in claim 1, wherein the grip has multiple bosses protruding from an outer surface thereof.

* * * * *